US011705003B2

(12) United States Patent
Nakashima et al.

(10) Patent No.: US 11,705,003 B2
(45) Date of Patent: Jul. 18, 2023

(54) INFORMATION PROCESSING APPARATUS, METHOD, AND NON-TRANSITORY COMPUTER READABLE MEDIUM FOR PROVIDING COMFORTABLE IN-VEHICLE ENVIRONMENT

(71) Applicant: TOYOTA JIDOSHA KABUSHIKI KAISHA, Toyota (JP)

(72) Inventors: Toyokazu Nakashima, Nagoya (JP); Yurika Tanaka, Yokosuka (JP); Shoji Sakamoto, Ichikawa (JP); Yusuke Kobayashi, Ota-ku (JP); Kotaro Okabe, Ichikawa (JP); Hirotada Nakanishi, Toyota (JP); Naoya Oka, Nagakute (JP); Daiki Otani, Nagoya (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

(21) Appl. No.: 17/669,750

(22) Filed: Feb. 11, 2022

(65) Prior Publication Data

US 2022/0301434 A1 Sep. 22, 2022

(30) Foreign Application Priority Data

Mar. 16, 2021 (JP) ..... 2021-042769

(51) Int. Cl.
*G08G 1/14* (2006.01)
*G08G 1/0962* (2006.01)
*G08G 1/04* (2006.01)

(52) U.S. Cl.
CPC ..... *G08G 1/146* (2013.01); *G08G 1/04* (2013.01); *G08G 1/0962* (2013.01)

(58) Field of Classification Search
CPC ..... G08G 1/146; G08G 1/04; G08G 1/0962
See application file for complete search history.

(56) References Cited

U.S. PATENT DOCUMENTS

| | | | | |
|---|---|---|---|---|
| 5,124,917 | A * | 6/1992 | Kanamori | B60G 17/018 701/37 |
| 10,900,444 | B2 * | 1/2021 | Dudar | F02M 25/0836 |
| 2011/0137511 | A1 * | 6/2011 | Harumoto | F02N 11/0814 701/31.4 |
| 2018/0118204 | A1 * | 5/2018 | Ito | B60W 30/09 |
| 2018/0297598 | A1 * | 10/2018 | Yaldo | B60W 30/16 |
| 2019/0073902 | A1 * | 3/2019 | Indoh | G06V 20/58 |
| 2019/0383239 | A1 * | 12/2019 | Dudar | F02M 25/0836 |
| 2020/0149907 | A1 * | 5/2020 | Iwaasa | G07C 5/008 |
| 2020/0167578 | A1 * | 5/2020 | Ding | B60R 11/04 |
| 2021/0107477 | A1 * | 4/2021 | Kim | B60W 40/02 |
| 2022/0114890 | A1 * | 4/2022 | Kato | G08G 1/096791 |
| 2022/0301434 | A1 * | 9/2022 | Nakashima | G08G 1/04 |

FOREIGN PATENT DOCUMENTS

JP 2010-031811 A 2/2010

* cited by examiner

*Primary Examiner* — Hoi C Lau
(74) *Attorney, Agent, or Firm* — Oliff PLC

(57) ABSTRACT

A controller of an information processing apparatus is configured to acquire information indicating a loudness of sound emitted by a second vehicle parked within a predetermined range from a first vehicle or a vehicle height of the second vehicle, and in a case in which the controller determines that the loudness or the vehicle height exceeds a predetermined first threshold, the controller provides a predetermined notification to the first vehicle via a communication interface.

20 Claims, 4 Drawing Sheets

INFORMATION PROCESSING APPARATUS, METHOD, AND NON-TRANSITORY COMPUTER READABLE MEDIUM FOR PROVIDING COMFORTABLE IN-VEHICLE ENVIRONMENT

CROSS-REFERENCE TO RELATED APPLICATION

This application claims priority to Japanese Patent Application No. 2021-042769 filed on Mar. 16, 2021, the entire contents of which are incorporated herein by reference.

TECHNICAL FIELD

The present disclosure relates to an information processing apparatus, a method, and a program.

BACKGROUND

Technology for providing comfortable in-vehicle environment is known. For example, Patent Literature (PTL) 1 discloses technology for making a driver aware of unnecessary idling conditions.

CITATION LIST

Patent Literature

PTL 1: JP 2010-031811 A

SUMMARY

There is room for improvement with respect to technology for providing comfortable in-vehicle environment.

It would be helpful to improve technology for providing comfortable in-vehicle environment.

An information processing apparatus according to an embodiment of the present disclosure includes a controller and a communication interface, the controller configured to:

acquire information indicating a loudness of sound emitted by a second vehicle parked within a predetermined range from a first vehicle or a vehicle height of the second vehicle; and in a case in which the controller determines that the loudness or the vehicle height exceeds a predetermined first threshold, the controller provides a predetermined notification to the first vehicle via the communication interface.

A method according to an embodiment of the present disclosure is a method performed by an information processing apparatus, the method including:

acquiring information indicating a loudness of sound emitted by a second vehicle parked within a predetermined range from a first vehicle or a vehicle height of the second vehicle; and providing a predetermined notification to the first vehicle, in a case in which the loudness or the vehicle height is determined to exceed a predetermined first threshold.

A program according to an embodiment of the present disclosure is configured to cause a computer to execute operations, the operations including:

acquiring information indicating a loudness of sound emitted by a second vehicle parked within a predetermined range from a first vehicle or a vehicle height of the second vehicle; and providing a predetermined notification to the first vehicle, in a case in which the loudness or the vehicle height is determined to exceed a predetermined first threshold.

According to an embodiment of the present disclosure, technology for providing comfortable in-vehicle environment is improved.

DETAILED DESCRIPTION

Hereinafter, an embodiment of the present disclosure will be described.

Outline of Embodiment

Figure 1:
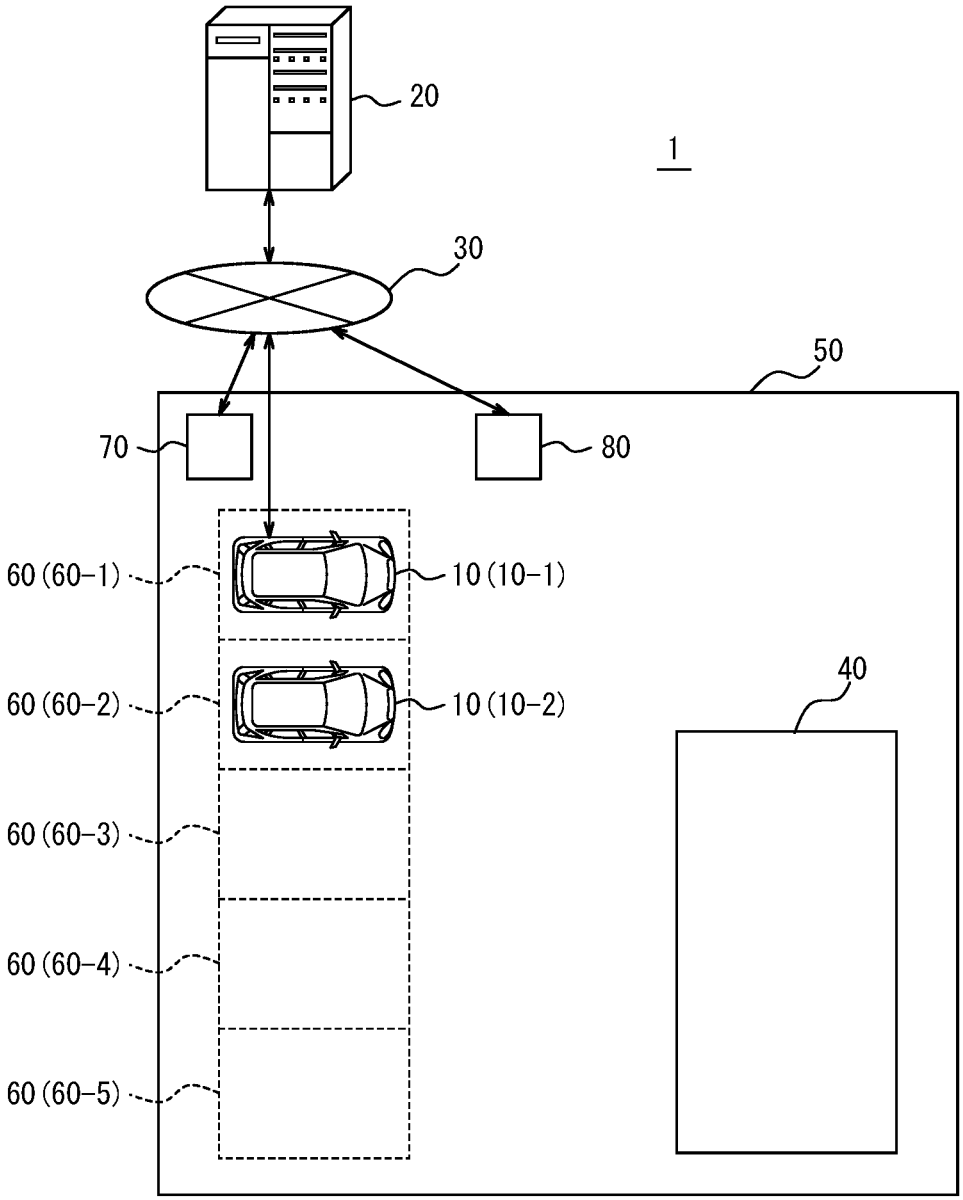
FIG. 1 is a block diagram illustrating a schematic configuration of a system according to an embodiment of the present disclosure.

An outline of a system 1 according to an embodiment of the present disclosure will be described with reference to FIG. 1. The system 1 includes a plurality of vehicles 10 and an information processing apparatus 20. The vehicles 10 and the information processing apparatus 20 are communicably connected to a network 30 including, for example, the Internet, a mobile communication network, or the like.

The plurality of vehicles 10 (each of the vehicles 10 is hereinafter referred to as a first vehicle 10-1, a second vehicle 10-2, . . . when distinguishing each of the plurality of vehicles 10) are automobiles, for example, but are not limited to these, and may be any vehicles. The automobiles may each be, for example, a gasoline-powered vehicle, a BEV (Battery Electric Vehicle), an HEV (Hybrid Electric Vehicle), a PHEV (Plug-in Hybrid Electric Vehicle), an FCEV (Fuel Cell Electric Vehicle), or the like, but are not limited to these. The number of the vehicles 10 provided in the system 1 may be freely determined.

The plurality of vehicles 10 are located in a parking lot 50 attached to a building 40, such as a commercial facility, for example. The parking lot 50 has a plurality of parking spaces 60 (each of the parking spaces 60 is hereinafter referred to as a parking space 60-1, 60-2, . . . when distinguishing each of the plurality of parking spaces 60). In the parking lot 50, there is installed an imaging device 70, including a camera that can communicate with the information processing apparatus 20 via the network 30, for example, and that can image the vehicles 10 located in the parking lot 50. The camera included in the imaging device 70 may be any camera. In the parking lot 50, there is also installed a sound collection device 80, including a microphone that can communicate with the information processing apparatus 20 via the network 30, for example, and that can collect sound in the parking lot 50. The microphone included in the sound collection device 80 may be any microphone.

The information processing apparatus 20 is, for example, a computer such as a server apparatus. The information processing apparatus 20 can communicate with the vehicles 10 via the network 30.

First, an outline of the present embodiment will be described, and details thereof will be described later. A controller 21 of the information processing apparatus 20 acquires information indicating a loudness of sound emitted by the second vehicle 10-2 parked within a predetermined range from the first vehicle 10-1. Then, in a case in which the controller 21 of the information processing apparatus 20 determines that the loudness of the sound emitted by the second vehicle 10-2 exceeds a predetermined first threshold, the controller 21 provides a predetermined notification to the first vehicle 10-1 via a communication interface 22.

Thus, according to the present embodiment, in a case in which the loudness of the sound emitted by the second vehicle 10-2 parked within the predetermined range from the first vehicle 10-1 exceeds the predetermined first threshold, the first vehicle 10-1 is provided with the predetermined notification. Thus, for example, when a person in the first vehicle 10-1 recognizes the configuration, the person can move away from the second vehicle 10-2 by moving the first vehicle 10-1. Accordingly, technology for providing comfortable in-vehicle environment is improved in that noise caused by the sound emitted by the second vehicle 10-2 is reduced in the first vehicle 10-1.

Next, configurations of the system 1 will be described in detail.

(Configuration of Vehicle)

Figure 2:
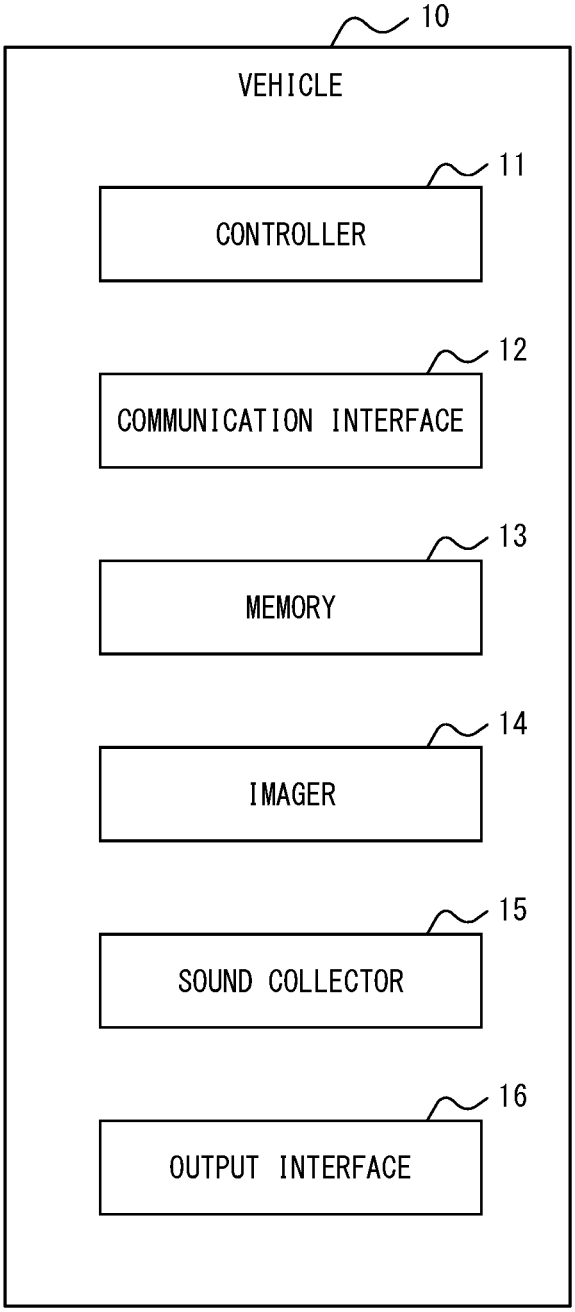
FIG. 2 is a block diagram illustrating a schematic configuration of a vehicle according to the embodiment of the present disclosure.

As illustrated in FIG. 2, the vehicles 10 each include a controller 11, a communication interface 12, a memory 13, an imager 14, a sound collector 15, and an output interface 16.

The controller 11 includes at least one processor, at least one programmable circuit, at least one dedicated circuit, or a combination of these. The processor is, for example, a general purpose processor such as a central processing unit (CPU) or a graphics processing unit (GPU), or a dedicated processor that is dedicated to specific processing, but is not limited to these. The programmable circuit is a field-programmable gate array (FPGA), for example, but is not limited to this. The dedicated circuit is an application specific integrated circuit (ASIC), for example, but is not limited to this. The controller 11 controls the operations of the entire vehicle 10.

The communication interface 12 includes at least one interface for communication for connecting to the network 30. The interface for communication is compliant with, for example, mobile communication standards such as the 4th generation (4G) standard or the 5th generation (5G) standard, but is not limited to these. In the present embodiment, the vehicle 10 communicates with the information processing apparatus 20 via the communication interface 12 and the network 30.

The memory 13 includes one or more memories. The memories are, for example, semiconductor memories, magnetic memories, optical memories, or the like, but are not limited to these. The memories included in the memory 13 may each function as, for example, a main memory, an auxiliary memory, or a cache memory. The memory 13 stores any information used for operations of the vehicle 10. For example, the memory 13 may store a system program, an application program, embedded software, and the like. The information stored in the memory 13 may be updated with, for example, information acquired from the network 30 via the communication interface 12.

The imager 14 includes an in-vehicle camera for generating images obtained by imaging subjects in the field of view. The images may be still images or moving images. The in-vehicle camera included in the imager 14 may be a monocular camera or a stereo camera. The imager 14 is installed in the vehicle 10 so that the imager 14 can image exterior scenery around the vehicle 10. For example, an electronic device having a camera function, such as a driving recorder or a smartphone used by an occupant, may function as the imager 14. In the present embodiment, the vehicle 10 generates images of exterior scenery around the vehicle 10 using the imager 14.

The sound collector 15 includes an in-vehicle microphone that collects sound around the vehicle 10. The in-vehicle microphone included in the sound collector 15 may be any microphone. The sound collector 15 is installed in the vehicle 10 so that the sound collector 15 can collect sound around the vehicle 10. For example, an electronic device having a microphone function, such as a smartphone used by an occupant, may function as the sound collector 15.

The output interface 16 includes an interface for output that outputs information generated by the controller 11 or information read from the memory 13 to a user. The interface for output may be, for example, a panel display or a head-up display that outputs information in the form of images, a speaker that outputs information in the form of sound, or the like, but is not limited to these, and may be any interface. The output interface 16 can notify a person in the vehicle 10 of information acquired via the communication interface 12, by sound, screen display, or the like.

(Configuration of Information Processing Apparatus)

Figure 3:
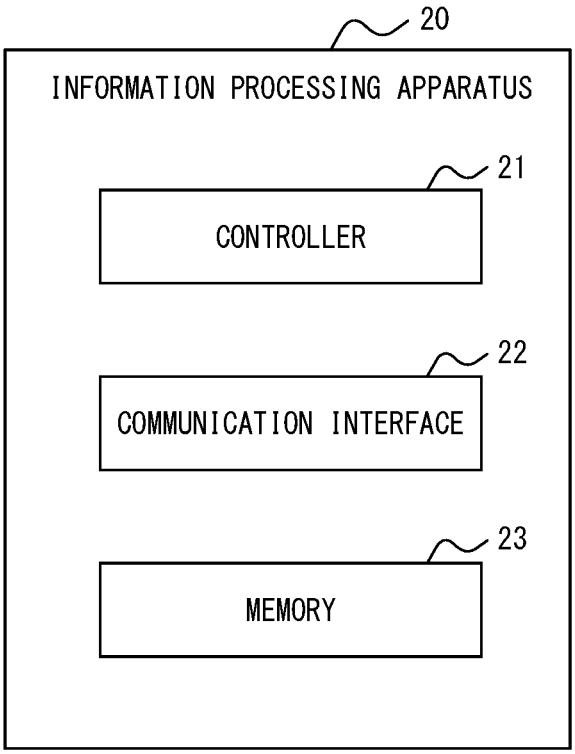
FIG. 3 is a block diagram illustrating a schematic configuration of an information processing apparatus according to the embodiment of the present disclosure.

As illustrated in FIG. 3, the information processing apparatus 20 includes a controller 21, a communication interface 22, and a memory 23.

The controller 21 includes at least one processor, at least one programmable circuit, at least one dedicated circuit, or a combination of these. The controller 21 controls the operations of the entire information processing apparatus 20.

The communication interface 22 includes at least one interface for communication for connecting to the network 30. The interface for communication is compliant with, for example, mobile communication standards, wired local area network (LAN) standards, or wireless LAN standards, but is not limited to these, and may be compliant with any communication standards. In the present embodiment, the information processing apparatus 20 communicates with the vehicles 10 via the communication interface 22 and the network 30.

The memory 23 includes one or more memories. The memories included in the memory 23 may each function as, for example, a main memory, an auxiliary memory, or a cache memory. The memory 23 stores any information used for operations of the information processing apparatus 20. For example, the memory 23 may store a system program, an application program, a database, map information, and the like. The information stored in the memory 23 may be updated with, for example, information acquired from the network 30 via the communication interface 22.

(Flow of Operations of Information Processing Apparatus)

Figure 4:
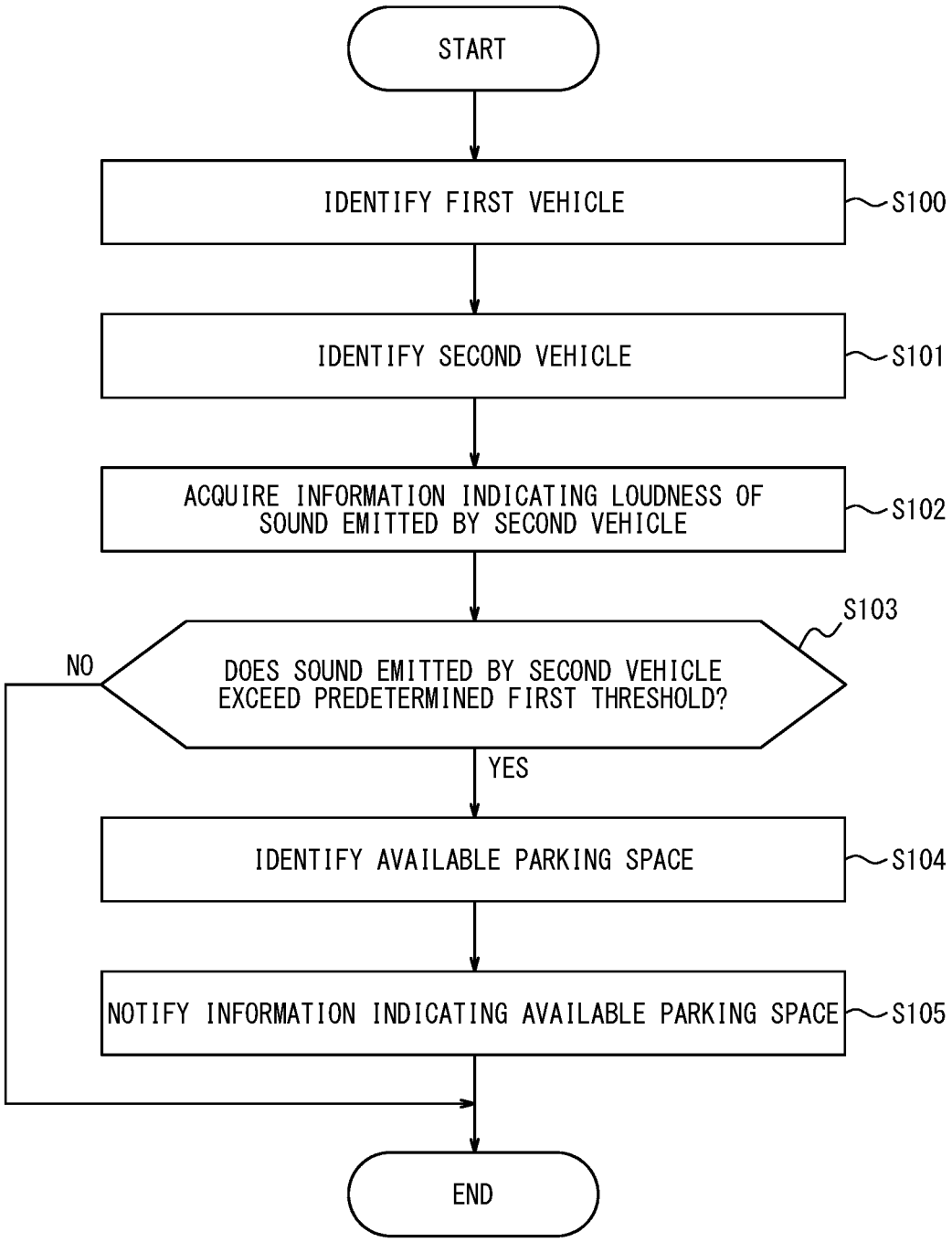
FIG. 4 is a flowchart illustrating operations of the information processing apparatus according to the embodiment of the present disclosure.

Operations of the information processing apparatus 20 according to the present embodiment will be described with reference to FIG. 4. These operations correspond to a method according to the present embodiment.

Step S100: The controller 21 of the information processing apparatus 20 identifies, as a first vehicle 10-1, any one of a plurality of vehicles 10, which are located in the parking lot 50 attached to the building 40, with a person in the vehicle.

Specifically, the controller 21 of the information processing apparatus 20 detects a vehicle 10 that is parked or is about to be parked in a parking space 60, from among the plurality of vehicles 10 located in the parking lot 50, based on parking lot information including information on the plurality of vehicles 10 located in the parking lot 50. Then, the controller 21 determines whether there is a person in the detected vehicle 10. In a case in which the controller 21 determines that there is a person in the vehicle 10, the controller 21 then identifies the vehicle 10 as a first vehicle 10-1. On the other hand, in a case in which the controller 21 does not determine that there is a person in the detected vehicle 10, the processing described above is repeated until a first vehicle 10-1 is identified. Here, the parking lot information may include image data on the plurality of vehicles 10 located in the parking lot 50, for example, captured by the imaging device 70. In this case, the controller 21 of the information processing apparatus 20 can detect, from the image data received from the imaging device 70 via the communication interface 22, a vehicle 10 that is parked or is about to be parked in a parking space 60 from among the plurality of vehicles 10 located in the parking lot 50, using any image recognition technology. Then, the controller 21 can determine whether there is a person in the detected vehicle 10, using any image recognition technology. In a case in which the controller 21 determines that there is a person in the vehicle 10, the controller 21 can then identify the vehicle 10 as a first vehicle 10-1. Here, as illustrated in FIG. 1, suppose that a vehicle 10 parked in the parking space 60-1 is identified as the first vehicle 10-1. The image data may be still image data or moving image data. The "vehicle 10 that is about to be parked" includes, for example, a vehicle 10 that is paused near a parking space 60, but is not limited to this.

Step S101: The controller 21 of the information processing apparatus 20 identifies, as a second vehicle 10-2, a vehicle 10 that is parked within a predetermined range from the first vehicle 10-1 identified in step S100.

Specifically, the controller 21 of the information processing apparatus 20 identifies a vehicle 10 that is parked within a predetermined range from the first vehicle 10-1, as a second vehicle 10-2, based on vehicle peripheral information including information around the first vehicle 10-1. Here, the vehicle peripheral information may include, for example, image data around the first vehicle 10-1 captured by the imager 14 of the first vehicle 10-1. In this case, the controller 21 of the information processing apparatus 20 can identify, from the image data received from the first vehicle 10-1 via the communication interface 22, a vehicle 10 that is parked within a predetermined range from the first vehicle 10-1, as a second vehicle 10-2, using any image recognition technology. Here, as illustrated in FIG. 1, suppose that a vehicle 10 parked in the parking space 60-2 is identified as the second vehicle 10-2. The "predetermined range" may be a range from the parking space 60-1 where the first vehicle 10-1 is parked to the adjacent parking space 60-2, or a range set as appropriate by the user, but is not limited to these.

Step S102: The controller 21 of the information processing apparatus 20 acquires information indicating a loudness of sound emitted by the second vehicle 10-2 identified in step S101.

Specifically, the controller 21 of the information processing apparatus 20 acquires, based on the vehicle peripheral information including the information around the first vehicle 10-1, information indicating a loudness of sound emitted by the second vehicle 10-2 identified in step S101. Here, the vehicle peripheral information may include, for example, sound data around the first vehicle 10-1 collected by the sound collector 15 of the first vehicle 10-1. In this case, the controller 21 of the information processing apparatus 20 can acquire, from the sound data received from the first vehicle 10-1 via the communication interface 22, information indicating a loudness of sound emitted by the second vehicle 10-2, using any sound recognition technology. Examples of the "sound emitted by the second vehicle 10-2" include sound associated with idling, sound of in-vehicle audio, sound of in-vehicle conversation, sound of a horn, and the like, but are not limited to these.

Step S103: The controller 21 of the information processing apparatus 20 determines whether the loudness of the sound emitted by the second vehicle 10-2 exceeds a predetermined first threshold. In a case in which the loudness of the sound emitted by the second vehicle 10-2 exceeds the predetermined first threshold (step S103—YES), the process proceeds to step S104. On the other hand, in a case in which the loudness of the sound emitted by the second vehicle 10-2 does not exceed the predetermined first threshold (step S103—NO), the process ends.

The "predetermined first threshold" may be a value set in advance in consideration of influence of the sound emitted by the second vehicle 10-2 on the interior of the first vehicle 10-1, or a value set as appropriate by the user, but is not limited to these. The "predetermined first threshold" may be set to a smaller value for a user who prefer quiet interior environment, for example, but is not limited to this.

Step S104: In a case in which the loudness of the sound emitted by the second vehicle 10-2 exceeds the predetermined first threshold (Step S103—YES), the controller 21 of the information processing apparatus 20 identifies at least one available parking space where the first vehicle 10-1 can be parked.

Specifically, the controller 21 of the information processing apparatus 20 identifies at least one available parking space where the first vehicle 10-1 can be parked, based on the parking lot information, which further includes vacant information in the parking lot 50. Here, the parking lot information may include, for example, image data on the parking lot 50 captured by the imaging device 70. In this case, the controller 21 of the information processing apparatus 20 can identify, from the image data received from the imaging device 70 via the communication interface 22, at least one available parking space where the first vehicle 10-1 can be parked, using any image recognition technology. This allows the person in the first vehicle 10-1 to move away from the second vehicle 10-2 by parking the first vehicle 10-1 in a different location from the current location, when the person recognizes a notification of step S105, which will be described below. Accordingly, technology for providing comfortable in-vehicle environment is improved in that noise caused by the sound emitted by the second vehicle 10-2 is reduced in the first vehicle 10-1.

In step S104, the controller 21 of the information processing apparatus 20 may identify at least one available parking space where environmental sound does not exceed a predetermined second threshold. Specifically, the controller 21 of the information processing apparatus 20 identifies at least one available parking space where environmental sound does not exceed a predetermined second threshold, based on the parking lot information, which further includes information on environmental sound in the parking lot 50. Here, the parking lot information may further include data indicating environmental sound in the parking lot 50 collected by the sound collection device 80, for example. In this case, the controller 21 of the information processing apparatus 20 can identify, from the data indicating the environmental sound received from the sound collection device 80 via the communication interface 22, at least one available parking space where the environmental sound does not exceed the predetermined second threshold, using any sound recognition technology. This allows the person in the first vehicle 10-1 to park the first vehicle 10-1 in the available parking space where the environmental sound does not exceed the predetermined second threshold, when the person recognizes a notification of step S105, which will be described below. Accordingly, technology for providing comfortable in-vehicle environment is further improved in that noise caused by the sound emitted by the second vehicle 10-2 is reduced and that noise caused by the environmental sound is also reduced at the new parking location of the first vehicle 10-1.

Examples of the "environmental sound" may include sound of an air conditioning system installed in the building 40, buzzer sound of an entrance gate of the parking lot 50, and the like, but are not limited to these. The "predetermined second threshold" may be a value set in advance in consideration of influence of sound on the interior of the first vehicle 10-1, or a value set as appropriate by the user, but is not limited to these. The "predetermined second threshold" may be set to a smaller value for a user who prefers quiet interior environment, for example, but is not limited to this. The "predetermined second threshold" may be the same as or different from the "predetermined first threshold" described above.

Here, in step S104, in a case in which the controller 21 of the information processing apparatus 20 identifies a plurality of available parking spaces where the environmental sound does not exceed the predetermined second threshold, the controller 21 may identify an available parking space where the environmental sound is minimal, from among the plurality of identified available parking spaces. Thereby, a lot of information is not outputted to the person in the first vehicle 10-1 in step S105, which will be described below, and hence annoyance is avoided.

Step S105: The controller 21 of the information processing apparatus 20 notifies the first vehicle 10-1, via the communication interface 22, of information indicating the at least one available parking space identified in step S104.

Specifically, the controller 21 of the information processing apparatus 20 transmits information indicating the at least one available parking space identified in step S104 to the first vehicle 10-1 via the communication interface 22. Then, the controller 11 of the first vehicle 10-1 receives, via the communication interface 12, the information indicating the at least one available parking space identified in step S104 from the information processing apparatus 20. Then, the controller 11 of the first vehicle 10-1 outputs the information indicating the at least one available parking space identified in step S104 to the person in the first vehicle 10-1 via the output interface 16 by sound, screen display, or the like. Note that, the information indicating the available parking space may include location information on a parking space where the vehicle 10 is not parked, among the parking spaces 60 that the parking lot 50 has, but is not limited to this.

Here, in a case in which a plurality of available parking spaces where the environmental sound does not exceed the predetermined second threshold are identified in step S104, the controller 21 of the information processing apparatus 20 may, in step S105, notify the first vehicle 10-1, via the communication interface 22, of information indicating an available parking space where the environmental sound is minimal. Thereby, a lot of information is not outputted to the person in the first vehicle 10-1, and hence annoyance is avoided.

As described above, the controller 21 of the information processing apparatus 20 of the present embodiment acquires the information indicating the loudness of the sound emitted by the second vehicle 10-2 parked within the predetermined range from the first vehicle 10-1. Then, in a case in which the controller 21 of the information processing apparatus 20 determines that the loudness of the sound emitted by the second vehicle 10-2 exceeds the predetermined first threshold, the controller 21 provides the predetermined notification to the first vehicle 10-1 via the communication interface 22.

According to such a configuration, in a case in which the loudness of the sound emitted by the second vehicle 10-2 parked within the predetermined range from the first vehicle 10-1 exceeds the predetermined first threshold, the first vehicle 10-1 is provided with the predetermined notification. Thus, for example, when the person in the first vehicle 10-1 recognizes the notification, the person can move away from the second vehicle 10-2 by moving the first vehicle 10-1. Accordingly, technology for providing comfortable in-vehicle environment is improved in that noise caused by the sound emitted by the second vehicle 10-2 is reduced in the first vehicle 10-1.

While the present disclosure has been described with reference to the drawings and examples, it should be noted that various modifications and revisions may be implemented by those skilled in the art based on the present disclosure. Accordingly, such modifications and revisions are included within the scope of the present disclosure. For example, functions or the like included in each component, each step, or the like can be rearranged without logical inconsistency, and a plurality of components, steps, or the like can be combined into one or divided.

As a variation, the configuration and operations of the information processing apparatus 20 may be distributed to a plurality of computers capable of communicating with each other. For example, an embodiment in which some or all of the components of the information processing apparatus 20 are provided in the vehicle 10 can also be implemented. For example, a navigation apparatus mounted in the vehicle 10 may be equipped with some or all of the components of the information processing apparatus 20.

As a variation, the controller 21 of the information processing apparatus 20 may acquire, instead of the above-described steps S102 and S103, information indicating a vehicle height of the second vehicle 10-2 that is parked within a predetermined range from the first vehicle 10-1. Then, in a case in which the controller 21 determines that the vehicle height of the second vehicle 10-2 exceeds a predetermined first threshold, the controller 21 may identify an available parking space adjacent to a parking space where a vehicle 10 having a lower vehicle height than the first vehicle 10-1 is parked, or an available parking space adjacent to a parking space where no vehicle 10 is parked. According to this variation, when the person in the first vehicle 10-1 feels uneasy at sight from the second vehicle 10-2, the person in the first vehicle 10-1 can avoid being in sight. Thus, technology for providing comfortable in-vehicle environment is improved. Note that, the "predetermined first threshold" may be a value set in advance in consideration of influence of sight from the second vehicle 10-2 on the interior of the first vehicle 10-1, or a value set as appropriate by the user, but is not limited to these.

Also, as a variation, in a case in which the loudness of the sound emitted by the second vehicle 10-2 parked within the predetermined range from the first vehicle 10-1 exceeds the predetermined first threshold, the controller 21 of the information processing apparatus 20 may, instead of the above-described step S104, identify, from among the plurality of parking spaces 60 that the parking lot 50 attached to the building 40 has, an available parking space located outside a predetermined range from a doorway of the building 40, or an available parking space located outside a predetermined range from a pedestrian walkway provided in the parking lot 50. Similarly, in a case in which the vehicle height of the second vehicle 10-2 parked within the predetermined range from the first vehicle 10-1 exceeds the predetermined first threshold, the controller 21 of the information processing apparatus 20 may identify, from among the plurality of parking spaces 60 that the parking lot 50 attached to the building 40 has, an available parking space located outside a predetermined range from the doorway of the building 40, or an available parking space located outside a predetermined range from the pedestrian walkway provided in the parking lot 50. According to these variations, the person in the first vehicle 10-1 can be distant from the doorway of the building 40 or the pedestrian walkway provided in the parking lot 50 in which there is relatively much noise or sight associated with human passage and the like. Thus, technology for providing comfortable in-vehicle environment is improved. The "predetermined range" may be a value set in advance in consideration of influence of noise or sight associated with human passage and the like on the interior of the first vehicle 10-1, or a value set as appropriate by the user, but is not limited to these.

As a variation, in a case in which the controller 21 of the information processing apparatus 20 determines that the loudness of the sound emitted by the second vehicle 10-2 exceeds the predetermined first threshold, the controller 21 of the information processing apparatus 20 may, instead of the steps S104 and S105 described above, send a notification indicating that the loudness of the sound emitted by the second vehicle 10-2 exceeds the predetermined first threshold to the first vehicle 10-1 via the communication interface 22. Similarly, in a case in which the controller 21 of the information processing apparatus 20 determines that the vehicle height of the second vehicle 10-2 exceeds the predetermined first threshold, the controller 21 may send a notification indicating that the vehicle height of the second vehicle 10-2 exceeds the predetermined first threshold to the first vehicle 10-1 via the communication interface 22. According to these variations, when the person in the first vehicle 10-1 recognizes the notification, the person can move away from the second vehicle 10-2. Thus, technology for providing comfortable in-vehicle environment is improved.

For example, an embodiment in which a general purpose computer functions as the information processing apparatus 20 according to the above embodiment can also be implemented. Specifically, a program in which processes for realizing the functions of the information processing apparatus 20 according to the above embodiment are written may be stored in a memory of a general purpose computer, and the program may be read and executed by a processor. Accordingly, the present disclosure can also be implemented as a program executable by a processor, or a non-transitory computer readable medium storing the program.

The invention claimed is:

1. An information processing apparatus comprising a controller and a communication interface, the controller configured to:

acquire information indicating a loudness of sound emitted by a second vehicle parked within a predetermined range from a first vehicle or a vehicle height of the second vehicle parked within the predetermined range from the first vehicle; and in a case in which the controller determines that the loudness or the vehicle height exceeds a predetermined first threshold, the controller provides a predetermined notification to the first vehicle via the communication interface.

2. The information processing apparatus according to claim 1, wherein the predetermined notification includes a notification indicating that the loudness or the vehicle height exceeds the predetermined first threshold.

3. The information processing apparatus according to claim 1, wherein in a case in which the controller determines that the loudness or the vehicle height exceeds the predetermined first threshold, the controller identifies at least one available parking space where the first vehicle can be parked, and the predetermined notification includes a notification indicating the identified at least one available parking space.

4. The information processing apparatus according to claim 3, wherein the information includes information indicating the loudness, and in a case in which the controller determines that the loudness exceeds the predetermined first threshold, the controller identifies at least one available parking space where environmental sound does not exceed a predetermined second threshold.

5. The information processing apparatus according to claim 4, wherein in a case in which a plurality of available parking spaces where the environmental sound does not exceed the predetermined second threshold are identified, the controller identifies, from among the plurality of identified available parking spaces, an available parking space where the environmental sound is minimal, and the predetermined notification includes a notification indicating the identified available parking space where the environmental sound is minimal.

6. The information processing apparatus according to claim 3, wherein the information includes information indicating the vehicle height, and in a case in which the controller determines that the vehicle height exceeds the predetermined first threshold, the controller identifies an available parking space adjacent to a parking space where a vehicle having a lower vehicle height than the first vehicle is parked, or an available parking space adjacent to a parking space where no vehicle is parked.

7. The information processing apparatus according to claim 3, wherein in a case in which the controller determines that the loudness or the vehicle height exceeds the predetermined first threshold, the controller identifies, from among a plurality of parking spaces that a parking lot attached to a building has, an available parking space located outside a predetermined range from a doorway of the building, or an available parking space located outside a predetermined range from a pedestrian walkway provided in the parking lot.

8. A method performed by an information processing apparatus, the method comprising:

acquiring information indicating a loudness of sound emitted by a second vehicle parked within a predetermined range from a first vehicle or a vehicle height of the second vehicle parked within the predetermined range from the first vehicle; and providing a predetermined notification to the first vehicle, in a case in which the loudness or the vehicle height is determined to exceed a predetermined first threshold.

9. The method according to claim 8, wherein the predetermined notification includes a notification indicating that the loudness or the vehicle height exceeds the predetermined first threshold.

10. The method according to claim 8, further comprising identifying at least one available parking space where the first vehicle can be parked, in a case in which the loudness or the vehicle height is determined to exceed the predetermined first threshold, wherein the predetermined notification includes a notification indicating the identified at least one available parking space.

11. The method according to claim 10, wherein the information includes information indicating the loudness, and in a case in which the loudness is determined to exceed the predetermined first threshold, the method further comprises identifying at least one available parking space where environmental sound does not exceed a predetermined second threshold.

12. The method according to claim 11, further comprising, in a case in which a plurality of available parking spaces where the environmental sound does not exceed the predetermined second threshold are identified, identifying, from among the plurality of identified available parking spaces, an available parking space where the environmental sound is minimal, wherein the predetermined notification includes a notification indicating the identified available parking space where the environmental sound is minimal.

13. The method according to claim 10, wherein the information includes information indicating the vehicle height, and in a case in which the vehicle height is determined to exceed the predetermined first threshold, the method further comprises identifying an available parking space adjacent to a parking space where a vehicle having a lower vehicle height than the first vehicle is parked, or an available parking space adjacent to a parking space where no vehicle is parked.

14. The method according to claim 10, further comprising, in a case in which the loudness or the vehicle height is determined to exceed the predetermined first threshold, identifying, from among a plurality of parking spaces that a parking lot attached to a building has, an available parking space located outside a predetermined range from a doorway of the building, or an available parking space located outside a predetermined range from a pedestrian walkway provided in the parking lot.

15. A non-transitory computer readable medium storing a program configured to cause a computer to execute operations, the operations comprising:

acquiring information indicating a loudness of sound emitted by a second vehicle parked within a predetermined range from a first vehicle or a vehicle height of the second vehicle parked within the predetermined range from the first vehicle; and providing a predetermined notification to the first vehicle, in a case in which the loudness or the vehicle height is determined to exceed a predetermined first threshold.

16. The non-transitory computer readable medium according to claim 15, wherein the operations further comprise identifying at least one available parking space where the first vehicle can be parked, in a case in which the loudness or the vehicle height is determined to exceed the predetermined first threshold, and the predetermined notification includes a notification indicating the identified at least one available parking space.

17. The non-transitory computer readable medium according to claim 16, wherein the information includes information indicating the loudness, and in a case in which the loudness is determined to exceed the predetermined first threshold, the operations further comprise identifying at least one available parking space where environmental sound does not exceed a predetermined second threshold.

18. The non-transitory computer readable medium according to claim 17, wherein the operations further comprise, in a case in which a plurality of available parking spaces where the environmental sound does not exceed the predetermined second threshold are identified, identifying, from among the plurality of identified available parking spaces, an available parking space where the environmental sound is minimal, and the predetermined notification includes a notification indicating the identified available parking space where the environmental sound is minimal.

19. The non-transitory computer readable medium according to claim 16, wherein the information includes information indicating the vehicle height, and in a case in which the vehicle height is determined to exceed the predetermined first threshold, the operations further comprise identifying an available parking space adjacent to a parking space where a vehicle having a lower vehicle height than the first vehicle is parked, or an available parking space adjacent to a parking space where no vehicle is parked.

20. The non-transitory computer readable medium according to claim 16, wherein the operations further comprise, in a case in which the loudness or the vehicle height is determined to exceed the predetermined first threshold, identifying, from among a plurality of parking spaces that a parking lot attached to a building has, an available parking space located outside a predetermined range from a doorway of the building, or an available parking space located outside a predetermined range from a pedestrian walkway provided in the parking lot.

* * * * *